US005309125A

United States Patent [19]

Perkins et al.

[11] Patent Number: 5,309,125

[45] Date of Patent: May 3, 1994

[54] COMPACT DELAY LINE FORMED OF CONCENTRICALLY STACKED, HELICALLY GROOVED, CYLINDRICAL CHANNEL-LINE STRUCTURE

[75] Inventors: Gilbert R. Perkins, Palm Bay; Douglas Heckaman, Indialantic, both of Fla.

[73] Assignee: Harris Corporation, Melbourne, Fla.

[21] Appl. No.: 950,071

[22] Filed: Sep. 23, 1992

[51] Int. Cl.[5] ..... H01P 9/02

[52] U.S. Cl. ..... 333/160; 333/162; 333/163

[58] Field of Search ..... 333/138, 140, 160–163, 333/156, 243, 239, 242, 244

[56] References Cited

U.S. PATENT DOCUMENTS

| | | | |
|---|---|---|---|
| 2,810,887 | 10/1957 | Ecklund et al. | 333/162 |
| 3,199,054 | 8/1965 | Holland et al. | 333/163 |
| 4,641,140 | 2/1987 | Hackaman et al. | 333/245 X |
| 4,894,628 | 1/1990 | Dadswell | 333/160 |

*Primary Examiner*—Seungsook Ham
*Attorney, Agent, or Firm*—Charles E. Wands

[57] ABSTRACT

A miniaturized cylindrical 'channeline' delay line comprises a plurality of concentrically stacked cylindrical elements, surfaces of which are configured to form helically contoured 'channeline' transmission line. The nested stack includes a first, generally cylindrical conductive spool body element, for example a lightweight and electrically conductive cylinder or spool, having a longitudinal axis and an outer, generally cylindrical surface in which a helical groove is formed. Concentrically surrounding this interior spool are one or more additional, generally cylindrical hollow electrically conductive hollow cylinders of successively increasing diameters. These additional electrically conductive hollow cylinders are sized, so that respective ones of the cylinders may be concentrically stacked about the longitudinal axis of the interior spool. Like the interior spool, each surrounding cylinder has a helical groove formed in its outer cylindrical surface. Snugly surrounding the outermost hollow cylinder is a conductive cylindrical cover for the structure, which has a generally cylindrical bore that is sized so as to accommodate the insertion of the interior spool and the concentrically stacked one or more cylindrical hollow cylinders into its bore. Respective lengths of insulator clad center conductor are wound within respective ones of the helical grooves in the interior spool and the cylinders, so as to be electrically insulated from the electrically conductive surfaces of respective ones of the helical grooves and the bores of adjacent body elements.

23 Claims, 4 Drawing Sheets

COMPACT DELAY LINE FORMED OF CONCENTRICALLY STACKED, HELICALLY GROOVED, CYLINDRICAL CHANNEL-LINE STRUCTURE

FIELD OF THE INVENTION

The present invention relates in general to delay line devices for high frequency communication systems (e.g. operating at a frequency on the order of 10–20 GHz) and is particularly directed to miniaturized delay line geometry configured of a plurality of concentrically stacked cylinders, in the surfaces of which helically configured channeline transmission line is formed.

FIELD OF THE INVENTION

Broad bandwidth microwave delay line components are employed in a variety of signal processing applications, such as electronic countermeasure loop circuits, switched time delay compensation networks for phased array antennas, pulse compression radar networks, altimeters and microwave test equipment. While acoustic wave devices, magnetic wave devices and optical devices are available for high frequency delay line applications, TEM mode or coaxial cable type components are often preferred for wide band microwave applications.

An example of a currently employed coaxial cable type delay line component is diagrammatically illustrated in perspective in FIG. 1, which shows a length of narrow diameter (e.g. on the order of 140 mils) coaxial cable 11 helically wrapped about a spool or mandrel 13, in an effort to confine a considerable length of coaxial cable to a relatively small volume. Opposite ends of the cable 11 are terminated with coax connector elements 15. Unfortunately, in order for the cable to possess the necessary mechanical strength within a 50–70 ohm range of characteristic impedance, the weight per unit length of coaxial cable 11 (which is determined by the size of its center conductor, surrounding insulation cladding and metallic shielding layer) is not insubstantial, so that both the volume and overall weight of the resulting spool-wound structure constitute physical drawbacks to an overall signal processing architecture, particularly in the case of a multi-component application, such as an airborne or spaceborne phased array antenna, where vast numbers of such elements may be required.

SUMMARY OF THE INVENTION

In accordance with the present invention, the size and weight penalties of conventional coaxial cable-wound delay line structures are significantly reduced by means of a miniaturized delay line structure, in which the conventional coaxial cable is replaced by a cylindrical 'channeline' type structure, specifically one having a plurality of concentrically stacked cylinders, the surfaces of which are configured to form helically contoured 'channeline' transmission line. By 'channeline' is generally meant a micro-miniaturized transmission line structure formed of an insulator-surrounded (which may include dielectric cladding layer and/or air) small diameter wire, which is inserted into a conductive-walled channel or groove and covered with a conductive layer, so as to effectively surround the wire with a ground plane or shielding layer, as described, for example, in the U.S. Pat. to Heckaman et al No. 4,641,140, assigned to the assignee of the present application and the disclosure of which is herein incorporated.

More particularly, the stacked cylindrical 'channeline' type delay line device according to the present invention is formed of a first, interior, generally cylindrical body element, for example a lightweight and electrically conductive (e.g. aluminum) cylinder or spool, having a longitudinal axis and an outer, generally cylindrical surface in which a helical groove is formed (e.g. machined or cast). Concentrically surrounding this interior spool is one or more additional, generally cylindrical hollow electrically conductive body elements, preferably in the form of hollow aluminum cylinders of successively increasing diameters. These additional electrically conductive hollow cylinders are sized, so that respective ones of the cylinders may be concentrically stacked about the longitudinal axis of the interior spool.

Like the interior spool, each surrounding cylinder has a helical groove formed in its outer cylindrical surface. Snugly surrounding the outermost hollow cylinder is a cylindrical cap or housing for the structure, which has a generally cylindrical bore that is sized so as to accommodate the insertion of the interior spool and the concentrically stacked one or more cylindrical hollow cylinders into its bore, so that the outermost cylindrical cap surrounds a plurality of generally cylindrical body elements that are stacked together concentrically with respect to the longitudinal axis.

Respective lengths of insulator clad center conductor are wound within respective ones of the helical grooves in the interior spool and the cylinders, so as to be electrically insulated from the electrically conductive surfaces of respective ones of the helical grooves and the bores of adjacent body elements. Electrical access to spaced apart helical locations of the lengths of center conductor is provided at prescribed external locations of the delay line device to provide a multi-tapped delay line. In order to provide electrical continuity among plural body elements, the cylindrical cap may be mounted to a base of the interior spool and a conductive washer inserted into the cap and thereby urged against the other cylinders, so as to provide resilient electrical and mechanical continuity among plural body elements.

DETAILED DESCRIPTION

Figure 2:
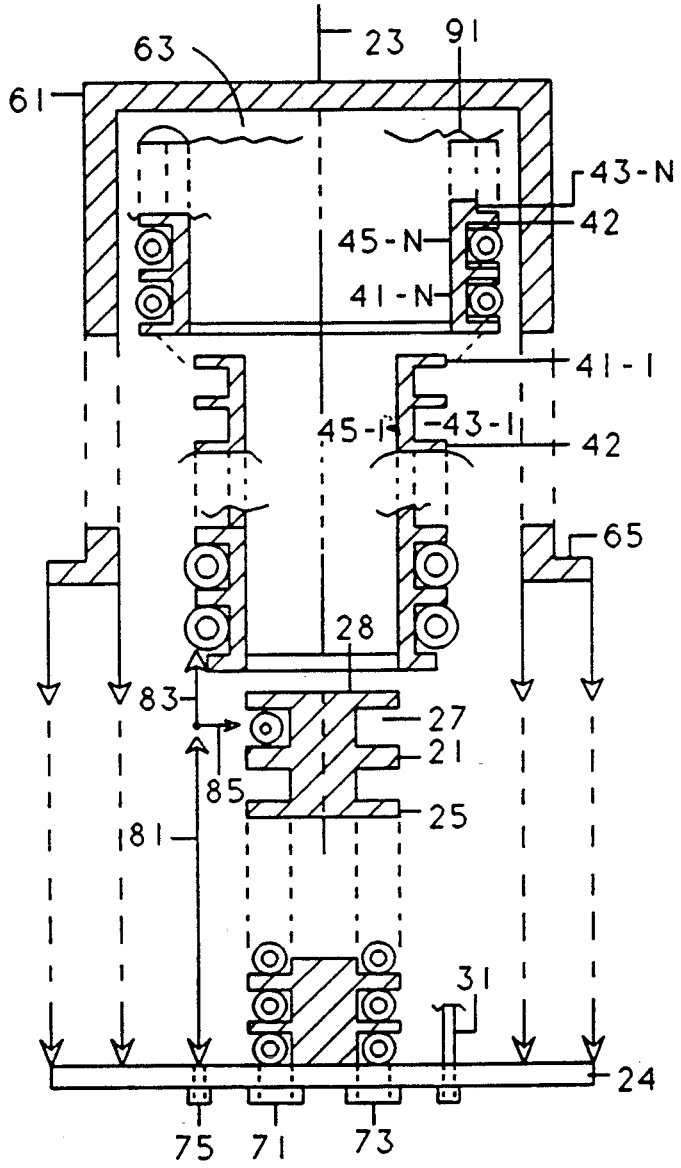
FIG. 2 diagrammatically illustrates a cross-sectional exploded view of a miniaturized multi-tapped TEM delay line structure in accordance with an embodiment of the present invention.

FIG. 2 diagrammatically illustrates a cross-sectional exploded view of an embodiment of a miniaturized delay line structure in accordance with the present invention, particularly a multi-tapped (TEM) delay line structure having a plurality of telescopically and concentrically stacked, electrically conductive cylinders, the outer surfaces of which are grooved to form helically contoured 'channeline' transmission line. As noted earlier by 'channeline' is generally meant a micro-miniaturized transmission line structure formed of an insulator-clad, small diameter wire, which is inserted into a conductive-walled channel or groove and covered with a conductive layer, so as to effectively surround the wire with a ground plane or shielding layer, as described in the above-referenced U.S. Patent to Heckaman et al.

More particularly, the multi-tapped delay line device shown in FIG. 2 comprises a first, interior, generally cylindrical body element 21, for example a lightweight and electrically conductive (e.g. aluminum) cylinder or spool, having a longitudinal axis 23 and a base portion 24. Base 24 provides both mechanical support and RFI/EMI shielding at the bottom of the delay line. Formed (e.g. machined or cast), in the outer, generally cylindrical surface 25 of spool 21 is a helical groove or channel, which effectively forms a 'screw thread' groove 27 extending from the top end 28 of the spool down to its base 24. Base 24 may form part of a TO-style header commonly employed in printed wiring board assemblies. The geometry parameters of the grooved spool (namely, the length and diameter of the spool body 21, proper, and the pitch of channel 27) effectively define the physical length of the groove and thereby the electrical length of the segment of the delay line to be formed in body 21.

Figure 1:
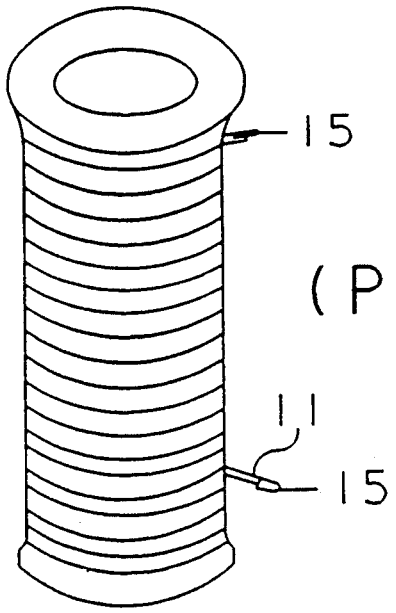
FIG. 1 (PRIOR ART)
FIG. 1 diagrammatically illustrates, in perspective, a conventional miniaturized delay line formed by helically wrapping a length of narrow diameter coaxial cable about a spool or mandrel.
Figure 4:
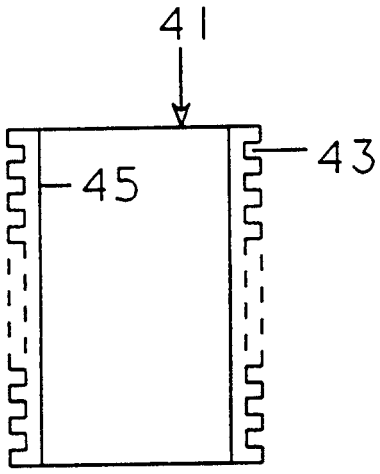
FIG. 4 is a cross sectional view of an individual grooved cylinder.
Figure 3:
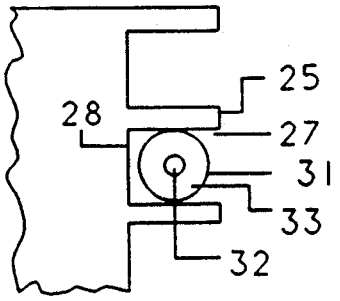
FIG. 3 shows an enlarged view of a portion of the helical channel structure of FIG. 2.

As diagrammatically illustrated in FIG. 3, which shows an enlarged view of a portion of the helical channel structure of FIG. 2, the size of a helical channel 27 in spool 21 is such as to accommodate the insertion of a length of dielectrically clad wire 31, having a center conductor 32 surrounded by a dielectric cladding (e.g. Teflon) layer 33, such that wire 31 is substantially flush with or slightly spaced away from the bottom 28 of the channel 27 and the outer surface 25 of the spool, so that depth and width of the channel are sufficient to accommodate the wire. Because the cross section of the channel may be generally rectangular or square, there is also a slight air gap between the wire and the conductive walls of the channel. The dielectric constants of the air gap and the insulator cladding of the wire define the values of respective capacitive reactance components that are distributed along the length of the center conductor 32 and the adjacent conductive material of the channel 27, which forms the ground plane or outer shield for the transmission line, as described in the above-referenced Heckaman et al patent. Because of this combination of air gap and the insulator cladding, the dimensions of a channeline transmission line structure having a characteristic impedance on the order of 50–70 ohms are reduced (e.g. on the order of 30–40%) compared with a conventional coaxial cable structure, such as that shown in FIG. 1. Concentrically surrounding spool 21 are one or more additional, generally cylindrical hollow electrically conductive body elements, shown as hollow, thin walled, aluminum sleeve elements or cylinders 41-1 . . . 41-N of successively increasing diameters. A cross sectional view of an individual grooved cylinder or sleeve is diagrammatically illustrated in FIG. 4.

As shown in the exploded cross sectional view of FIG. 2, these additional electrically conductive hollow cylinders are sized such that respective ones of the cylinders 41-1 . . . 41-N are concentrically telescopically stacked around the longitudinal axis 23 of interior spool 21, thereby achieving a very high three-dimensional packing density. The outer surface 42 of each of hollow cylinders 41-1 . . . 41-N has a respective helical groove or channel 43-1 . . . 43-N, similar to channel 27 in spool 21. The dimensions of the channels 41 within the surrounding cylinders and the wire cross section geometry are tailored to define a prescribed characteristic impedance (e.g. 50–70 ohms). Thus, in a multi-body element structure, the groove direction or pitch changes from cylinder to cylinder in order to maintain a constant characteristic impedance among all of the stacked elements.

Figure 5:
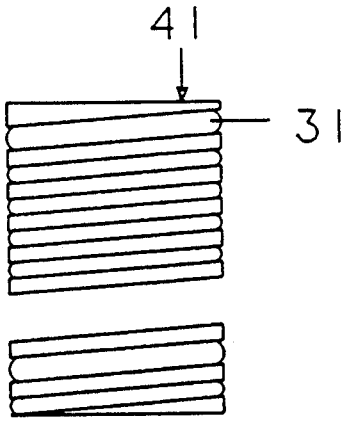
FIG. 5 shows the insertion of a length of insulator-clad wire into the 'screw thread' grooves of an individual conductive cylinder.
Figure 6:
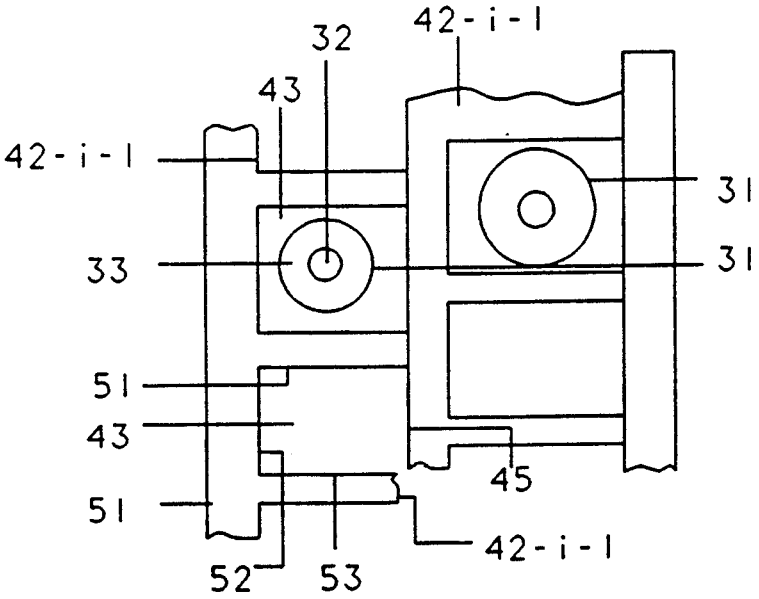
FIG. 6 diagrammatically illustrates the manner in which the diameter of the interior cylindrical surface of a respective cylinder is sized to snugly surround the outer grooved surface of an adjacent body element.

Like interior spool 21, the grooves or channels 43 of 'screw thread'-grooved cylinders 41 are sized so as to accommodate the insertion of a length of insulator clad wire 31, as shown in FIG. 5 and in enlarged detail in FIG. 6, which diagrammatically illustrates the manner in which the diameter of the interior cylindrical surface 45 of a respective cylinder 41-i is sized to snugly surround the outer grooved surface 42-i-1 of an adjacent body element (e.g. spool 21 or hollow cylinder 41-i-1). Namely, the conductive walls 51, 52, 53 of the helical channel 43 of body element 41-i-1 and the interior cylindrical surface 45 of a surrounding cylindrical body element 41-i effectively form a conductive ground plane that surrounds insulator clad wire 31, thereby forming a channeline structure. This is similar to placing a conductive overlay above a channel as described in the above-referenced Heckaman et al patent, in that the cylindrical delay line structure of the present invention covers a helical channel of one cylindrical body with the cylindrical bore of a surrounding electrically conductive (cylindrical) body.

Respective lengths of insulator clad wire 31 are wound within respective ones of the helical grooves or channels or spools 21 and surrounding cylinders 41, and the successive ends of the wires of immediately adjacent body elements are sequentially interconnected to one another so as to form a serial delay line. As shown in FIG. 2, a terminal end of the wire is wound within the helical channel 27 of spool 21 may be coupled to an external connector 71 at the base 24 of spool 21. Similarly a terminal end of the wire wound in the helical channel 43 of outermost grooved cylinder 41-N may be coupled to an external connector 73 at the base 24 of spool 21. Each of the connectors that are mounted in base 24 preferably employ glass-to-metal sealing pins to provide 50–70 ohm RF terminal ports for the delay line.

Figure 7:
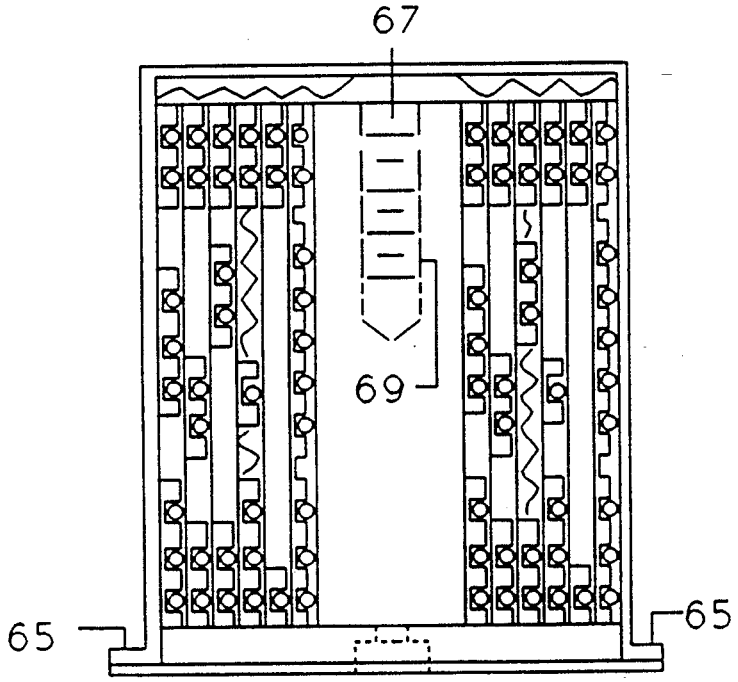
FIG. 7 is a cross sectional assembly illustration of a multi-cylinder delay line showing the manner in which a cap may be attached to the interior spool by means of a screw which is threaded into a tapped bore in the spool 21.

To complete the delay line structure, an outermost, electrically conductive cylindrical cover or cap 61 has a generally cylindrical hollow bore 63, which is sized so as to accommodate the insertion of the spool 21 and concentrically stacked cylinders 41. Cap 61 has a flange 65 that joins base 24 of spool 21, so as to form a shielding housing for the delay line. FIG. 7 shows the manner in which cap 61 may be attached to spool 21 by means of a screw 67, which is threaded into a tapped bore 69 in spool 21. The length of cap 61 is such that its flange 65 is firmly urged against base 24 of spool 21 when the cap is screwed onto the top of the spool 21, thereby ensuring ground plane, shielding continuity throughout the assembled delay line.

To provide a multi-tapped long delay line, electrical access to spaced apart helical locations of the lengths of center conductor may be provided at prescribed external locations of the delay line device. This may be effected, as diagrammatically shown in FIG. 2, for example, by extending respective lengths of wire, shown at 81, that connect to terminal junction locations 83, 85 at which respective segments of wire 31 that are helically wrapped in the channels of respective body elements, such as spool 21 and cylinder 41-1, to one or more additional external connectors 75 in the spool base. To provide electrical continuity among plural body elements, a conductive wave type, spring washer 91 may be inserted into cap 61, so that it is held against the ends of the cylinders 41 and provides resilient electrical and mechanical continuity among plural body elements as cap 61 is attached to spool 21, as shown in FIG. 7. Namely, the diameters of the bores of the sleeve members may be somewhat larger than the diameters of their outer cylindrical surfaces. As a result, the stacking or nesting of the cylinders and spools together may leave some degree of play or gap between a bore surface of a larger diameter sleeve/cylinder and the outer wall cylindrical surface of a smaller diameter sleeve/cylinder of spool element that has been inserted into the bore. This gap prevents electrical continuity of the shielding ground plane that surrounds the insulated conductor within the helical channel. By providing a conductive spring washer, all cylindrical members are conductively interconnected so as to maintain the surrounding walls of the helical channels at the same reference (ground) potential.

Figure 8:
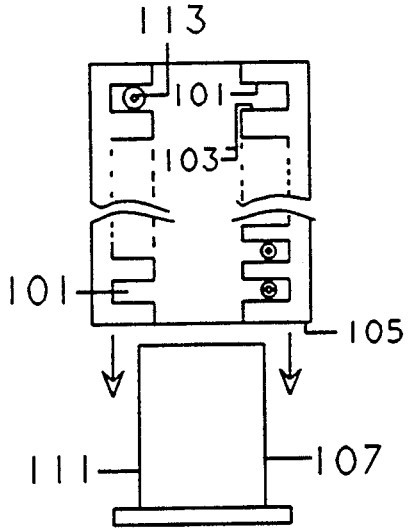
FIG. 8 shows an alternative embodiment of the present invention in which a helical channel is formed in the interior bore surface of a generally cylindrical sleeve member, into which a second conductive cylindrical member is inserted.

In the above-described embodiment of the invention, a helical groove is formed in the outer surface of a generally cylindrical member (e.g. spool or sleeve member) which, in turn, is inserted into a cylindrical bore of a surrounding conductive sleeve member. It should be observed, however, that the invention is not limited to this configuration. Alternatively, as illustrated in FIG. 8, a helical channel 101 may be formed in the interior bore surface 103 of a first, generally cylindrical sleeve member 105, into which a second conductive cylindrical member 107 is inserted. The outer surface 111 of this second conductive cylindrical member is relatively smooth, so that it cooperates with the helical channel 101 in the interior bore of the surrounding cylindrical sleeve to define the helical channel line ground plane, through which an insulated conductor 113 extends.

As will be appreciated from the foregoing description, the size and weight penalties of conventional coaxial cable-wound delay line structures are significantly reduced by means of the miniaturized delay line structure of the present invention, in which the conventional coaxial cable is replaced by a cylindrical 'channeline' type structure, in which a plurality of lightweight (e.g. aluminum) cylindrical sleeve members, the surfaces of which are configured to form helically contoured 'channeline' transmission line, may be concentrically nested or stacked together, to form a compact, continuous long delay line structure that is readily interconnectable to microwave transmission line support structures, such as TO-type packaging components.

While we have shown and described several embodiments in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed is:

1. A delay line device comprising:

a first body element having an outer, generally cylindrical surface in which a helical groove is formed, said helical groove having an electrically conductive surface;

a second body element having a generally cylindrical bore therethrough, into which bore said first body element is inserted, so that said second body element surrounds said first body element, said generally cylindrical bore having an electrically conductive surface; and a helically wound length of conductor which is clad with a dielectric jacket which extends continuously along said helically wound length of conductor, said helically wound length of dielectric jacket clad conductor being supported within said helical groove in a manner so as to be electrically insulated by the dielectric jacket extending continuously along said helically wound length of conductor from the electrically conductive surfaces of said helical groove and said generally cylindrical bore.

2. A delay line device according to claim 1, wherein said first and second body elements are made of conductive material.

3. A delay line device according to claim 1, wherein said second body element comprises a generally cylindrical conductive sleeve member.

4. A delay line device according to claim 3, wherein said generally cylindrical conductive sleeve member has an outer, generally cylindrical outer surface in which a conductive helical groove is formed, and wherein said clad conductor is supported within the helical groove formed in the outer surface of said generally conductive sleeve member and is electrically insulated therefrom by said dielectric jacket, and further including a third body element having a generally cylindrical, electrically conductive bore, into which bore said generally cylindrical sleeve member is inserted, so that said third body element surrounds said generally cylindrical sleeve member, and wherein said clad conductor extends into and is supported within the helical groove formed in the outer surface of said generally conductive sleeve member and is electrically insulated therefrom and from the electrically conductive bore of said third body element by said dielectric jacket.

5. A delay line device according to claim 4, wherein said third body element comprises a generally cylindrical, conductive outer sleeve member.

6. A delay line device according to claim 5, wherein electrical access to spaced apart helical locations of said conductor is provided at prescribed external locations of said delay line device.

7. A delay line device according to claim 5, wherein said outer sleeve member is attached to said first body element and further including a conductive washer which is captured between said outer sleeve member and said first and second body elements and provides electrical continuity among said body elements.

8. A delay line device according to claim 7, wherein said conductive washer comprises a conductive spring washer which provides resilient electrical and mechanical continuity among said body elements.

9. A delay line device comprising:

a first, generally cylindrical body element having a longitudinal axis and an outer, generally cylindrical surface in which a helical groove is formed, said helical groove having an electrically conductive surface;

a plurality of generally cylindrical hollow body elements of successively increasing diameters, wherein respective ones of said body elements are concentrically stacked about the longitudinal axis of said first body element, and wherein each of said hollow body elements has an electrically conductive, generally cylindrical bore and an outer, generally cylindrical surface in which a helical groove is formed; which helical groove has an electrically conductive surface;

an outer body element having a generally cylindrical bore into which bore said first body element and said plurality of generally cylindrical hollow body elements are inserted, so that said outer body element surrounds said plurality of generally cylindrical hollow body elements and said first body element that are stacked together concentrically about said longitudinal axis, the generally cylindrical bore of said outer body element having an electrically conductive surface; and respective lengths of conductor which are supported within each of respective ones of said helical grooves in a manner so as to be electrically insulated from the electrically conductive surfaces of respective ones of said helical grooves and the bores of adjacent body elements.

10. A delay line device according to claim 9, wherein said respective lengths of conductor comprise dielectrically jacketed conductive wire that are wound within said helical grooves.

11. A delay line device according to claim 9, wherein each body element is made of conductive material.

12. A delay line device according to claim 9, wherein electrical access to spaced apart helical locations of said lengths of conductor is provided at prescribed external locations of said delay line device.

13. A delay line device according to claim 9, wherein said outer body element is attached to said first body element and further including a conductive washer which is captured between said outer body element and said plurality of generally cylindrical hollow body elements and provides electrical continuity among plural body elements.

14. A delay line device according to claim 13, wherein said conductive washer comprises a conductive spring washer which provides resilient electrical and mechanical continuity among plural body elements.

15. A method of forming a delay line device comprising the steps of:

(a) forming a helical groove in an outer surface of an electrically conductive, cylindrical body element having a longitudinal axis;

(b) forming a helical groove in an outer surface of each of a plurality of electrically conductive, generally cylindrical hollow body elements of successively increasing diameters, which are sized so that respective ones of said body elements are concentrically stacked about the longitudinal axis of said electrically conductive, cylindrical body element;

(c) placing respective lengths of insulated conductor wire within each of respective ones of said helical grooves in a manner so as to be electrically insulated from the electrically conductive surfaces of respective ones of said helical grooves of adjacent body elements;

(d) placing said plurality of electrically conductive, generally cylindrical body elements and said first body element within a cylindrical bore and an outer body element, which bore is sized so as to accommodate the insertion of said first body element and a concentrically stacked plurality of said generally cylindrical hollow body elements therein, so that said outer body elements surrounds said plurality of generally cylindrical hollow body elements and said first body element that are stacked together concentrically about said longitudinal axis; and (e) providing electrical connections to said conductor wire.

16. A method according to claim 15, further including the step of (f) providing electrical access to spaced apart helical locations of lengths of conductor at prescribed external locations of said delay line device.

17. A method according to claim 15, further including the step of (f) attaching said outer body element to said electrically conductive, cylindrical body element and inserting a conductive washer between said outer body element and said plurality of body elements so as to provide electrical continuity among plural body elements.

18. A method according to claim 17, wherein said conductive washer comprises a conductive spring washer which, when inserted in step (f), provides resilient electrical and mechanical continuity among plural body elements.

19. A delay line device comprising a first body element having an electrically conductive generally cylindrical outer surface and a second body element having an electrically conductive bore, into which bore, said first body element is inserted, and wherein a helical groove is formed in the cylindrical surface of one of said first and second body elements, said helical groove having an electrically conductive surface, and a helically wound length of conductor clad with a dielectric jacket which extends continuously along said helically wound length of conductor, said helically wound length of dielectric jacket clad conductor being supported within said helical groove in a manner so as to be electrically insulated from the electrically conductive surfaces of said helical groove and said generally cylindrical bore by the dielectric jacket clad extending continuously along said conductor.

20. A delay line device according to claim 19, wherein said first and second body elements are made of conductive material.

21. A delay line device according to claim 19, further including a conductive member which engages and provides electrical continuity between said first and second body elements.

22. A delay line device according to claim 21, wherein said helical groove is formed in the electrically conductive, generally cylindrical outer surface of said first body element, whereby, with said first body element inserted in to the electrically conductive bore of said second body element, the interior conductive bore of said second body element forms a conductive shield together with the helical groove in said first body element.

23. A delay line device according to claim 22, wherein said conductive member comprises a conductive spring washer which provides resilient electrical and mechanical continuity between said first and second body elements.

* * * * *